US012270270B2

(12) United States Patent
Firth et al.

(10) Patent No.: US 12,270,270 B2
(45) Date of Patent: Apr. 8, 2025

(54) SYSTEM AND METHOD FOR CLEANING AND INSPECTING A WELLHEAD

(71) Applicant: INNOVEX DOWNHOLE SOLUTIONS, INC., Houston, TX (US)

(72) Inventors: Gary Firth, Houston, TX (US); Brian Sneed, Houston, TX (US); Jesus Terrones, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 686 days.

(21) Appl. No.: 17/502,255

(22) Filed: Oct. 15, 2021

(65) Prior Publication Data

US 2022/0120155 A1 Apr. 21, 2022

Related U.S. Application Data

(60) Provisional application No. 63/092,623, filed on Oct. 16, 2020.

(51) Int. Cl.

| | |
|---|---|
| ***E21B 33/06*** | (2006.01) |
| ***E21B 33/068*** | (2006.01) |
| ***E21B 37/04*** | (2006.01) |
| ***E21B 47/002*** | (2012.01) |

(52) U.S. Cl.
CPC ..... *E21B 33/068* (2013.01); *E21B 37/04* (2013.01); *E21B 47/002* (2020.05)

(58) Field of Classification Search
CPC ..... E21B 33/068; E21B 47/002; E21B 37/04; G02B 23/26
USPC ..... 15/104.061
See application file for complete search history.

(56) References Cited

U.S. PATENT DOCUMENTS

| | | | | |
|---|---|---|---|---|
| 7,467,979 | B2 | 12/2008 | Colescott et al. | |
| 9,366,600 | B2 * | 6/2016 | Ruhge | G01M 15/14 |
| 2006/0200001 | A1 * | 9/2006 | Keller | G02B 23/26 600/156 |
| 2015/0341600 | A1 * | 11/2015 | Hatcher, Jr. | H04N 23/50 348/82 |
| 2017/0210304 | A1 * | 7/2017 | Davies | B60R 11/04 |
| 2019/0218878 | A1 | 7/2019 | Sneed et al. | |

FOREIGN PATENT DOCUMENTS

| | | | | |
|---|---|---|---|---|
| WO | WO-2018232508 | A1 * | 12/2018 | G21C 1/20 |

* cited by examiner

*Primary Examiner* — Katina N. Henson
(74) *Attorney, Agent, or Firm* — MH2 Technology Law Group, LLP

(57) ABSTRACT

A tool includes a body, a cleaning system including nozzles coupled to the body and configured to spray a fluid onto an interior of a wellsite component, and an inspection system coupled to the body. The inspection system is configured to capture images, video, or both of the wellsite component that are to be used to determine whether the wellsite component is clean after being sprayed with the fluid.

19 Claims, 9 Drawing Sheets

SYSTEM AND METHOD FOR CLEANING AND INSPECTING A WELLHEAD

CROSS-REFERENCE TO RELATED APPLICATIONS

This application claims priority to U.S. Provisional Patent Application No. 63/092,623, which was filed on Oct. 16, 2020 and is incorporated herein by reference in its entirety.

BACKGROUND

Wellheads are connected to the top of a well and act as a surface termination for the well. Further, wellheads generally provide for a production tubing hanger to be installed therein, and production tubing extends downward from the tubing hanger into the well. Produced fluid is received up through the production tubing and through the wellhead (e.g., via valves, rams, seals, or other surface equipment).

Liners or other tubulars may be cemented in place within the well after the wellhead is installed and before the tubing hanger is installed. A portion of this cement may inadvertently solidify in the wellhead at a location that would interfere with the connection and/or seals between the wellhead and the tubing hanger or another component. To remove this cement prior to installing the tubing hanger, a washdown tool is positioned in the wellhead. The washdown tool sprays liquid (e.g., water) at high pressure to remove the cement from the interior of the wellhead. The washdown tool is then removed from the wellhead, and a camera is run into the wellhead to visually inspect the interior of the wellhead to determine whether the cement has been sufficiently removed. If the cement has not been sufficiently removed, the camera is removed from the wellhead, and the washdown tool is run into the wellhead again. This process continues until the cement has been sufficiently removed. As will be appreciated, this may be a time-consuming and expensive effort.

SUMMARY

Embodiments of the disclosure include a tool including a body, a cleaning system including nozzles coupled to the body and configured to spray a fluid onto an interior of a wellsite component, and an inspection system coupled to the body. The inspection system is configured to capture images, video, or both of the wellsite component that are to be used to determine whether the wellsite component is clean after being sprayed with the fluid.

Embodiments of the disclosure include a method including positioning a wellhead tool in a wellhead, cleaning the wellhead using a cleaning system of the wellhead tool, inspecting an interior of the wellhead using an inspection system of the wellhead tool that is configured to capture images, video, or both of an interior surface of the wellhead, without removing the wellhead tool from within the wellhead between cleaning and inspecting, determining that the wellhead is clean based on the captured images, video, or both, and removing the wellhead tool from the wellhead in response to determining that the wellhead is clean.

Embodiments of the disclosure include a tool including a body having a bore, a cleaning system comprising nozzles coupled to the body and configured to spray a fluid onto an interior of a wellsite component, and an inspection system with a camera that is movable at least partially in the bore. The inspection system includes a piston that separates the bore into an upper piston chamber and a lower piston chamber, and the piston is configured to move with respect to the body so as to actuate the camera from the extended configuration to the retracted configuration in response to a pressure differential between the upper and lower piston chambers.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
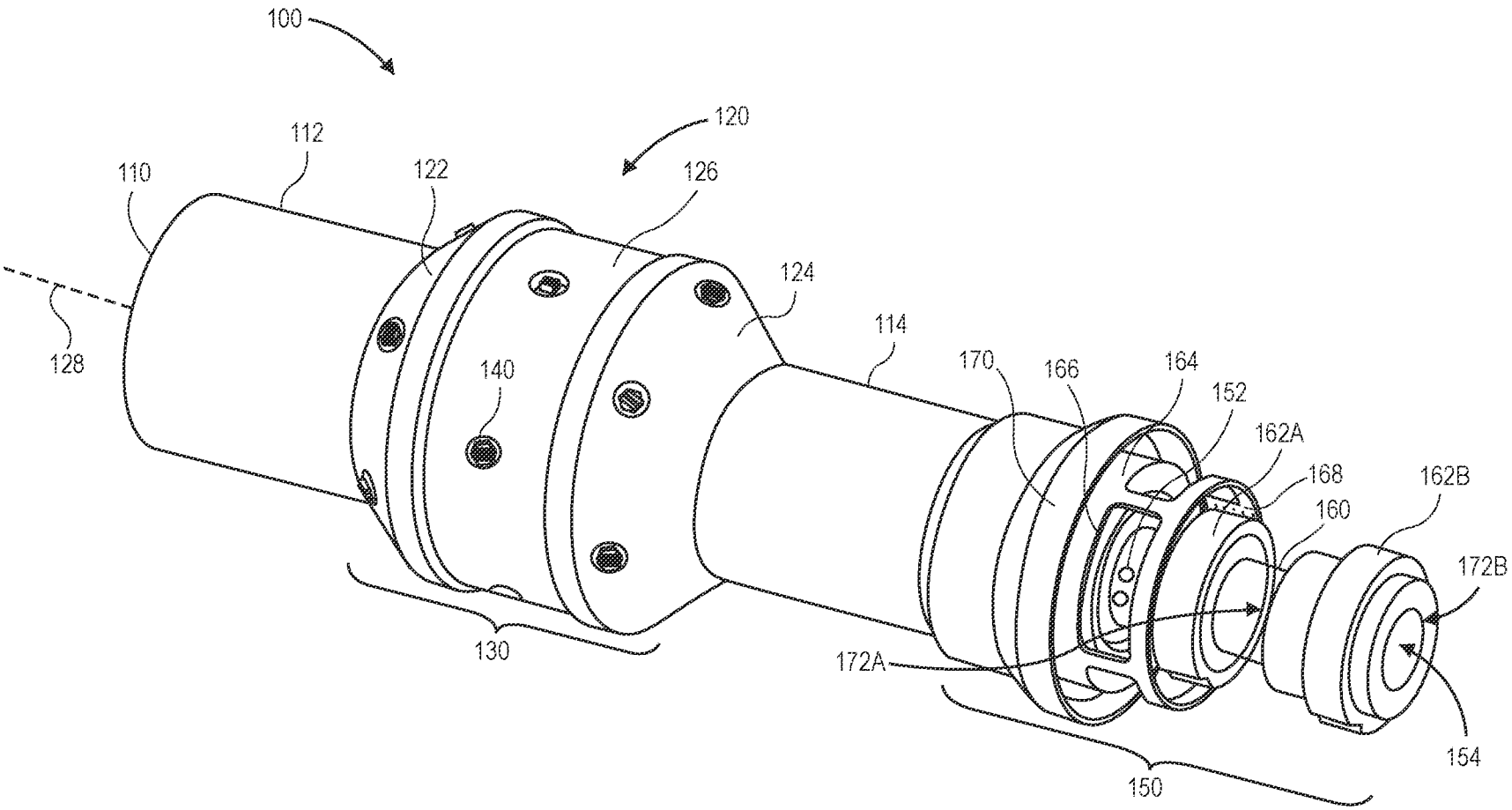
FIG. 1 illustrates a perspective view of a wellhead tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

A wellhead tool is described below. The wellhead tool may be configured to clean a wellhead and to visually inspect the wellhead (e.g., to determine whether the wellhead is clean) during a single trip into the wellhead. Performing these two functions with a single tool (i.e., the wellhead tool) in a single trip may improve efficiency when compared to the conventional techniques described above, which include multiple tools and multiple trips.

FIG. 1 illustrates a perspective view of a wellhead tool 100, according to an embodiment. The wellhead tool 100 may include a body 110. The body 110 may be a single (e.g., integral) component, or the body 110 may include a plurality of components that are coupled together. The body 110 may include a first (e.g., upper) portion 112, a second (e.g., lower) portion 114, and a radial protrusion 120 positioned therebetween.

The radial protrusion 120 may extend radially outward from the upper and lower portions 112, 114. The radial protrusion 120 may include a first (e.g., upper) surface portion 122, a second (e.g., lower) surface portion 124, and a third (e.g., intermediate) surface portion 126. The upper surface portion 122 may be sloped at an angle 123 (see FIG. 2) with respect to a central longitudinal axis 128 through the body 110 such that a cross-sectional width (e.g., diameter) increases proceeding in a downward direction (e.g., to the right in FIG. 1). The angle 123 may be from about 20° to about 90° (i.e., perpendicular to the axis) or about 30° to about 60°. As used herein, "about" refers to +/−5°. Similarly, the lower surface portion 124 may be sloped at an angle 125 (see FIG. 2) with respect to the axis 128 through the body 110 such that a cross-sectional width (e.g., diameter) increases proceeding in an upward axial direction (e.g., to the left in FIG. 1). The angle 125 may be from about 20° to about 90° (i.e., perpendicular to the axis) or about 30° to about 60°. The intermediate surface portion 126 may be substantially cylindrical and/or parallel to the axis 128 through the body 110.

The wellhead tool 100 may also include a cleaning system 130. As shown, the cleaning system 130 may be located on and/or coupled to the radial protrusion 120. More particularly, the cleaning system 130 may be located on the upper surface portion 122, the lower surface portion 124, the intermediate surface portion 126, or a combination thereof. Although not shown, the cleaning system 130 may also or instead be located on the upper portion 112 and/or the lower portion 114 of the body 110. The cleaning system 130 may include one or more nozzles 140. As described in greater detail below, a fluid (e.g., water) may be pumped down through the body 110 and sprayed outward through the nozzles 140 at high pressure to clean an interior of a wellhead (e.g., to remove cement or debris from the interior of the wellhead). The nozzles 140 may be axially offset from one another with respect to the axis 128, circumferentially offset from one another with respect to the axis 128, or both.

The wellhead tool 100 may also include an inspection system 150. The inspection system 150 may be located below the radial protrusion 120 and/or the cleaning system 130. For example, the inspection system 150 may be located at least partially in and/or below the second portion 114 of the body 110.

The inspection system 150 may include one or more cameras (two are shown: a radial camera 152 and an axial camera 154). The cameras 152, 154 may be configured to view and/or record an interior of the wellhead to allow a user to determine whether the cleaning system 130 has cleaned the interior of the wellhead to a predetermined threshold. More particularly, the cameras 152, 154 may capture images and/or video of the interior of the wellhead (e.g., a shoulder on the interior of the wellhead), and the images and/or video may be used to determine whether the cleaning system 130 has cleaned the shoulder of the wellhead such that a subsequent engagement between a tubing hanger and the shoulder is not compromised by cement or debris therebetween. The cameras 152, 154 may be configured to capture the images and/or video before the cleaning system 130 cleans the interior of the wellhead, simultaneously with the cleaning system 130 cleaning the interior of the wellhead, after the cleaning system 130 cleans the interior of the wellhead, or a combination thereof.

The radial camera 152 may be configured to view radially outward from the axis 128. Although a single radial camera 152 is shown, in other embodiments, a plurality of radial cameras 152 may be axially and/or circumferentially offset from one another. In one embodiment, the line of sight of the radial camera 152 may be fixed with respect to the body 110, and the wellhead tool 100 may be rotated (e.g., 360°) within the wellhead to view around the inner circumference of the wellhead. In another embodiment, the radial camera 152 may be configured to rotate (e.g., 360°) around the axis 128 with respect to the body 110 to view around the inner circumference of the wellhead.

The axial camera 154 may be configured to view axially downward (e.g., to the right in FIG. 1). In other words, the line of sight of the axial camera 154 may be parallel and/or aligned with the axis 128. The axial camera 154 may be positioned below the radial camera 152 and/or radially inward from the radial camera 152.

A transparent portion 160 may be included, in which the cameras 152 and/or 154 are housed and through which the cameras 152 and/or 154 are able to capture images. The transparent portion 160 may be or include a hollow tube made of glass, plastic, PLEXIGLAS®, or the like. For example, the transparent portion 160 may extend entirely around the radial camera 152. As will be appreciated, the transparent portion 160 is different/separate from a lens of the radial camera 152 and/or the axial camera 154. For example, radial camera 152 may include a radially oriented lens that is positioned within and spaced apart from the transparent portion 160.

The inspection system 150 may include one or more guards (two are shown: 162A, 162B). The guards 162A, 162B may be positioned at least partially around the transparent portion 160 and configured to protect the transparent portion 160 and/or the cameras 152, 154 from contacting and/or being damaged by the wellhead. The guards 162A, 162B may be axially offset from one another.

A shield 164 may be provided as part of the body 110 and/or coupled to the body 110. For example, the shield 164 may be coupled to or integral with the lower portion 114 of the body 110, as described in greater detail below. The shield 164 may be positioned radially outward from the transparent portion 160 and/or the guards 162A, 162B. The shield 164 may define one or more windows 166. The windows 166 may be circumferentially offset from one another around the axis 128. The line of sight of the radial camera 152 may extend through the transparent portion 160 and the window(s) 166.

One or more markings 168 on an inner surface thereof of the shield 164. As shown, the markings 168 are axially offset from one another in a direction that is parallel to the axis 128. The markings 168 may be within the field of view of the radial camera 152 and may be used to assist with depth perception (e.g., to gauge how far the interior of the wellhead is from the radial camera 152).

A skirt 170 of the inspection system 150 may protrude radially outward from the shield 164. The skirt 170 may be at least partially conical or frustoconical with the cross-sectional width (e.g., diameter) increasing proceeding away from the cleaning system 130 and/or toward the cameras 152, 154 (e.g., to the right in FIG. 1). The skirt 170 may be positioned above the radial camera 152 so as to not interfere (or only partially interfere) with the field of view of the radial camera 152. The skirt 170 may be configured to at least partially prevent the fluid that is sprayed by the cleaning system 130 from obstructing the views of the cameras 152, 154. In at least one embodiment, the inspection system 150 may also or instead include a wiper (not shown) that is configured to move with respect to the transparent portion 160 to wipe the fluid, cement, debris, etc. from the transparent portion 160 so that the radial camera 152 can see through the transparent portion 160.

The inspection system 150 may also include one or more lights 172A, 172B that are configured to shine on the interior of the wellhead. The lights 172A, 172B may shine upward, downward, radially outward, or a combination thereof. For example, the lights 172A may shine radially outward, and the lights 172B may be or include a ring or halo that shines downward. The lights 172A, 172B may be or include light emitting diodes (LEDs). The lights 172A, 172B may emit light in the visible or infrared spectrum.

In at least one embodiment, the wellhead tool 100 may also or instead include a global positioning system (GPS), an accelerometer, a gyroscope, or the like to measure various properties of the wellhead tool 100 while inside the wellhead.

Figure 2:
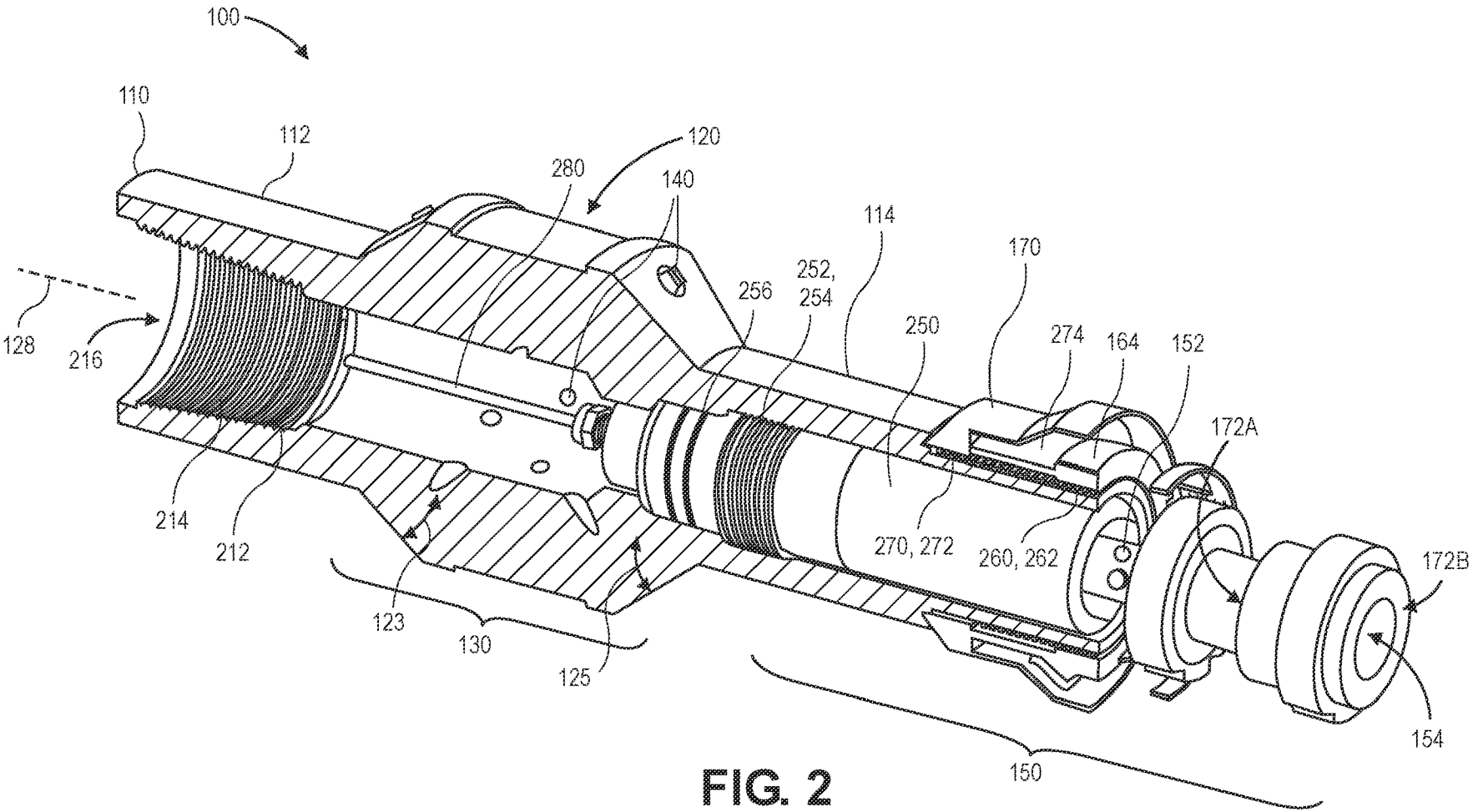
FIG. 2 illustrates a cross-sectional view perspective of the wellhead tool, according to an embodiment.
Figure 3:
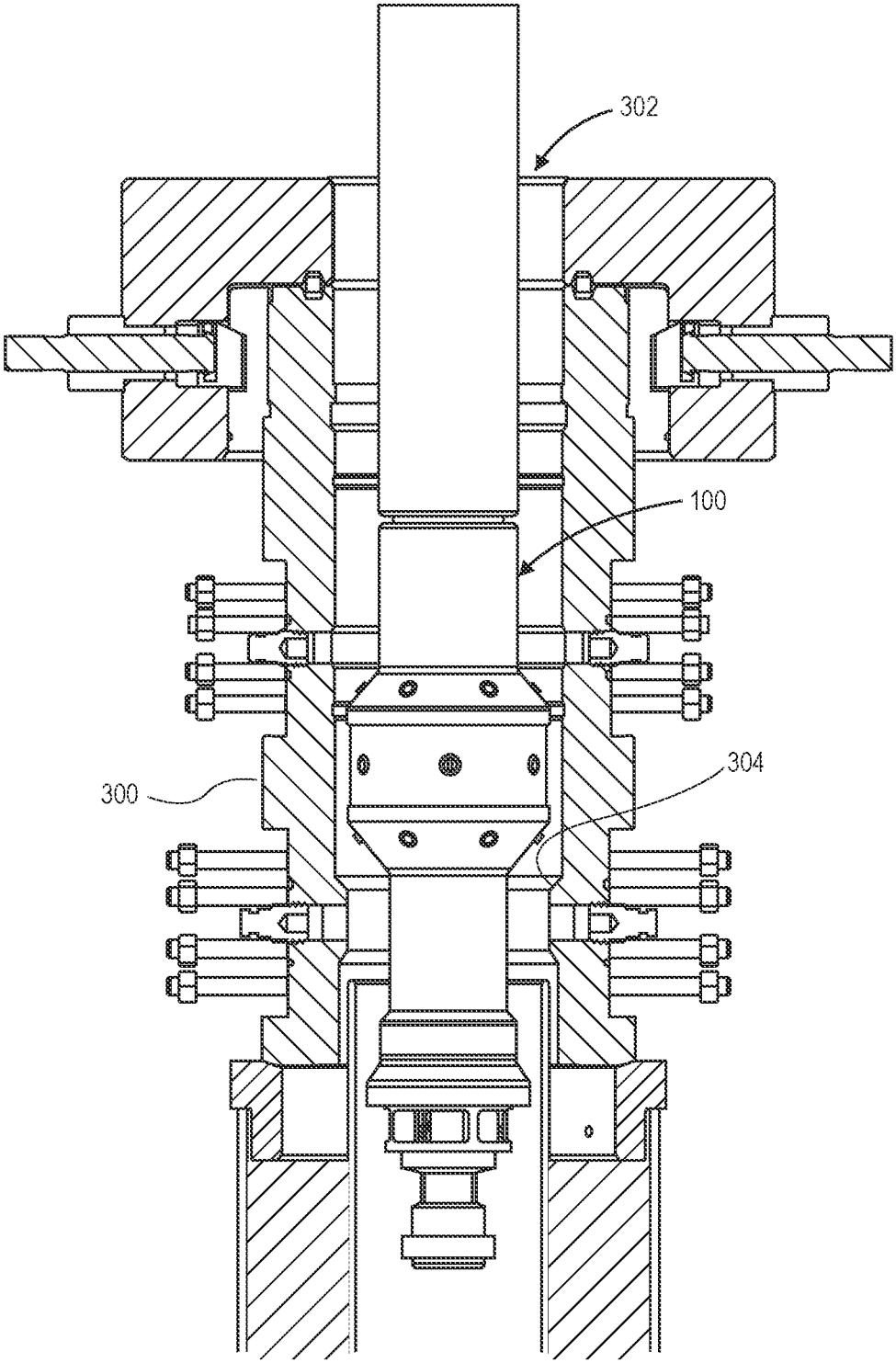
FIG. 3 illustrates a cross-sectional side view of the wellhead tool positioned within a wellhead, according to an embodiment.

FIG. 2 illustrates a cross-sectional perspective view of the wellhead tool 100, according to an embodiment. As shown, the upper portion 112 of the body 110 may be configured to be coupled to a tubular member (the tubular member is shown in FIG. 3). For example, an inner surface 212 of the upper portion 112 may define threads 214 that are configured to engage with the corresponding threads on the outer surface of the tubular member. The inner surface 212 of the body 110 may also define a bore 216 that extends axially therethrough. As described in greater detail below, the fluid may be pumped down through the bore 216, and the fluid may flow radially outward through the nozzles 140 and into contact with the inner surface of the wellhead.

At least a portion of the inspection system 150 may be positioned at least partially within the bore 216. More particularly, the inspection system 150 may include a camera housing 250 that is positioned at least partially within the body 110. The housing 250 may be configured to be coupled to the body 110. As shown, an outer surface of the housing 250 may define threads 252 that are configured to engage with corresponding threads 254 on an inner surface of the lower portion 114 of the body 110. One or more seals (e.g., O-rings) 256 may be positioned at least partially between the body 110 and the housing 250. The housing 250 and/or the seals 256 may obstruct the bore 216 and prevent the fluid from flowing downward therepast (e.g., to the right in FIG. 2). This may protect at least a portion of the inspection system 150 (e.g., the cameras 152, 154) from the high pressure of the fluid. As a result, the fluid may flow downward through the bore 216 and then flow outward through the nozzles 140.

As shown, the shield 164 may include threads 260 on an inner surface thereof that are configured to engage with corresponding threads 262 on the outer surface of the lower portion 114 of the body 110. Similarly, the skirt 170 may include threads 270 on an inner surface thereof that are configured to engage with corresponding threads 272 on the outer surface of the lower portion 114 of the body 110. The threads 260, 262 may be positioned below the threads 270, 272. In one embodiment, the threads 262, 272 may be or include the same set of threads. In one embodiment, a radial gap 274 may be present between the shield 164 and the skirt 170.

A cable 280 may be coupled to the camera housing 250 and may extend upward (e.g., to the left in FIG. 2) through the bore 216 to a computing system at the surface. The computing system may transmit signals to the inspection system 150 and/or receive signals from the inspection system 150. The transmitted signals may be or include commands that cause the cameras 152, 154 to capture images and/or video, zoom in and/or out, adjust brightness, change the field of view (e.g., cause the radial camera 152 to rotate), etc. The received signals may include the captured images and/or video.

FIG. 3 illustrates a cross-sectional side view of the wellhead tool 100 positioned within a wellhead 300, according to an embodiment. The wellhead 300 may define a substantially vertical bore 302. An inner surface of the wellhead 300 may also include an engagement surface (e.g., a shoulder) 304 that is configured to receive a tubing hanger (not shown). The shoulder 304 may protrude inward from a remainder of the bore 302, and the tubing hanger may land on the shoulder 304 and be suspended downward therefrom. As described above, cement or other debris may become positioned on the inner surface of the wellhead 300 (e.g., on the shoulder 304), which may interfere with landing the tubing hanger on the shoulder 304.

Figure 4:
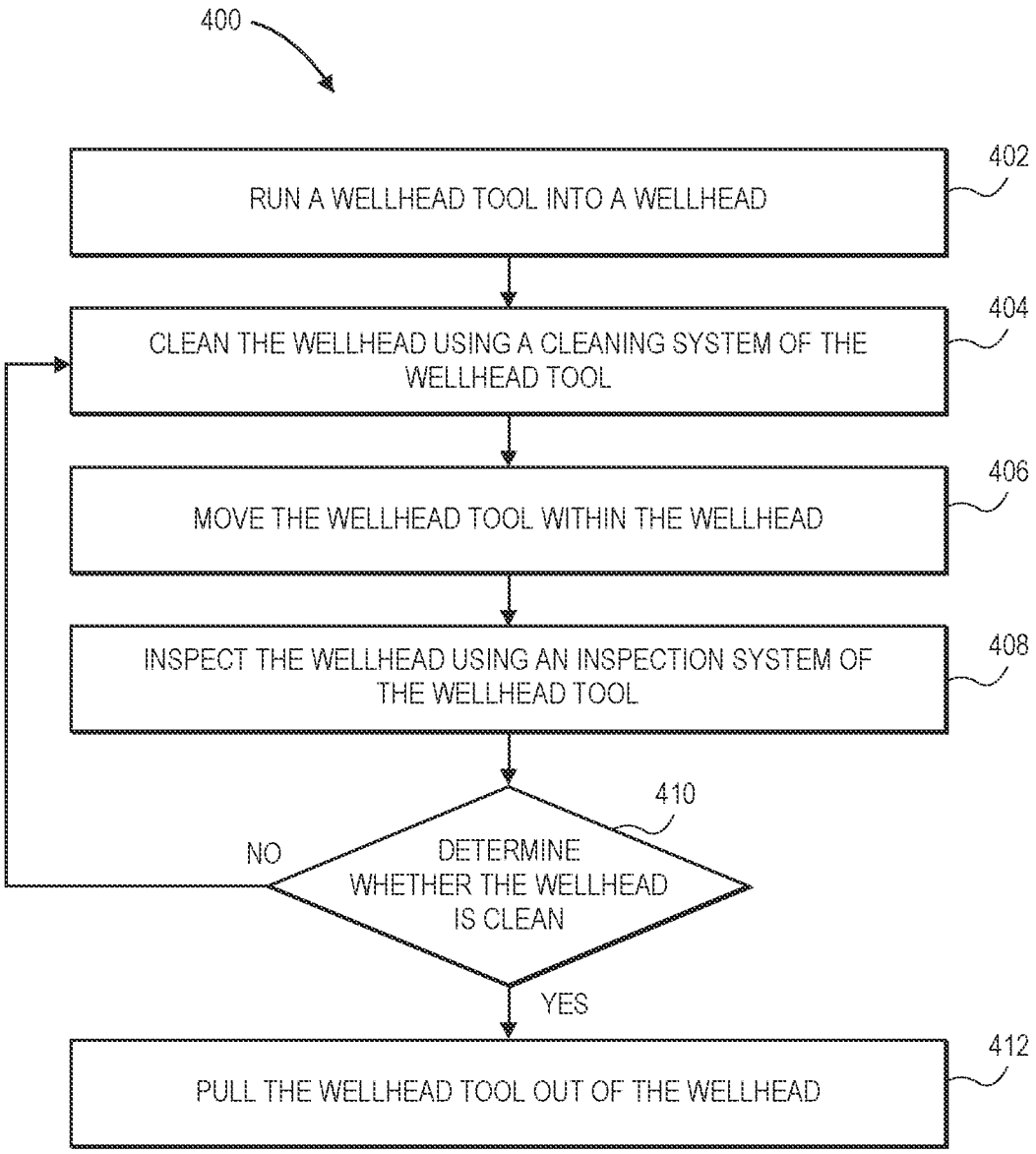
FIG. 4 illustrates a flowchart of a method for cleaning the wellhead using the wellhead tool, according to an embodiment.

FIG. 4 illustrates a flowchart of a method 400 for cleaning the wellhead 300 using the wellhead tool 100, according to an embodiment. An illustrative order of the method 400 is described below; however, one or more portions of the method 400 may be performed in a different order, performed in parallel (e.g., simultaneously), repeated, or omitted.

The method 400 may include running the wellhead tool 100 into the wellhead 300, as at 402. This may include lowering the wellhead tool 100 into the into the bore 302 until the nozzles 140 are positioned proximate to the shoulder 304 of the wellhead 300. In at least one embodiment, a cross-sectional width (e.g., diameter) of the radial protrusion 120 of the wellhead tool 100 may be greater than a cross-sectional width (e.g., diameter) of the shoulder 304 of the wellhead 300. In this embodiment, the wellhead tool 100 may be lowered until the radial protrusion 120 contacts the shoulder 304, and then the wellhead tool 100 may be raised up a predetermined distance. The predetermined distance may be less than about 20 cm, less than about 10 cm, or less than about 5 cm. In another embodiment, the cross-sectional width of the radial protrusion 120 of the wellhead tool 100 may be less than the cross-sectional width of the shoulder 304 of the wellhead 300, which may allow the wellhead tool 100 to pass downward through the wellhead 300.

The method 400 may also include cleaning the wellhead 300 using the cleaning system 130 of the wellhead tool 100, as at 404. For example, a pump (not shown) at the surface may cause the fluid to flow downward into the bore 216 of the wellhead tool 100. The fluid may then flow out of the wellhead tool 100 through the nozzles 140. The fluid may contact the inner surface of the wellhead 300 (e.g., the shoulder 304) and clean cement and/or debris from the inner surface of the wellhead 300. As mentioned above, the housing 250 and/or the seals 256 may prevent the fluid from flowing out through the lower end of the body 110. In addition, the skirt 170 may reduce/minimize the amount of fluid in the annulus (e.g., between the wellhead tool 100 and the wellhead 300) that contacts the transparent portion 160 and/or obstructs the view of the cameras 152, 154.

The method 400 may also include moving the wellhead tool 100 within the wellhead 300, as at 406. The wellhead tool 100 may be moved before the fluid is pumped (e.g., at 404), simultaneously with the fluid being pumped, and/or after the fluid is pumped. Moving the wellhead tool 100 may help to clean a greater surface area within the wellhead 300 (e.g., when compared to the wellhead tool 100 remaining in one location within the wellhead 300). Moving the wellhead tool 100 may include moving the wellhead tool 100 axially (e.g., up and down) within the wellhead 300. Moving the wellhead tool 100 may also or instead include rotating the wellhead tool 100 within the wellhead 300. The wellhead tool 100 may be rotated around the axis 128. In one embodiment, moving the wellhead tool 100 may also or instead include moving the nozzles 140 with respect to the body 110 to vary the angle(s) at which the fluid is sprayed. As mentioned above, the nozzles 140 may be moved while the wellhead tool 100 is in the wellhead 300 in response to a signal from the computing system.

The method 400 may also include inspecting the wellhead 300 using the inspection system 150 of the wellhead tool 100, as at 408. The wellhead 300 may be inspected before the fluid is pumped (e.g., at 404), simultaneously with the fluid being pumped, and/or after the fluid is pumped. The wellhead 300 may be inspected before the wellhead tool 100 is moved (e.g., at 406), simultaneously with the wellhead tool 100 being moved, and/or after the wellhead tool 100 is moved. Inspecting the wellhead 300 may include capturing images and/or video of the interior of the wellhead 300 using the radial camera 152, the axial camera 154, or both. The images and/or video may be transmitted to the computing system, which may display the images and/or video for a user to view. In one embodiment, the computing system may be at the surface, and the images and/or video may be transmitted to the computing system via the cable 280 (e.g., in real time) while the wellhead tool 100 is positioned within the wellhead 300. In another embodiment, the computing system may be in the wellhead tool 100 (e.g., in the housing 250), and the images and/or video may be retrieved from the computing system after the wellhead tool 100 is pulled out of the wellhead 300.

The method 400 may also include determining whether the wellhead 300 is clean, as at 410. The determination may be based at least partially upon the images and/or video captured by the inspection system 150. In one embodiment, the determination may be made by the user. In another embodiment, the determination may be made by the computing system. For example, the computing system may use a machine learning (ML) algorithm to compare the images and/or video from the inspection system 150 to a database of images and/or video that have previously been labelled as clean or not clean.

If the wellhead 300 is determined to be clean, the method 400 may include pulling the wellhead tool 100 out of the wellhead 300, as at 412. If the wellhead 300 is determined not to be clean, the method 400 may loop back around to cleaning (or re-cleaning) the wellhead 300 using the cleaning system 130 of the wellhead tool 100, as at 404. Thus, the method 400 may allow the wellhead tool 100 to clean and inspect (and, if needed, re-clean) the wellhead 300 in a single trip of the wellhead tool 100 into the wellhead 300. This is an improvement upon conventional techniques that require multiple tools and multiple trips.

Figure 5:
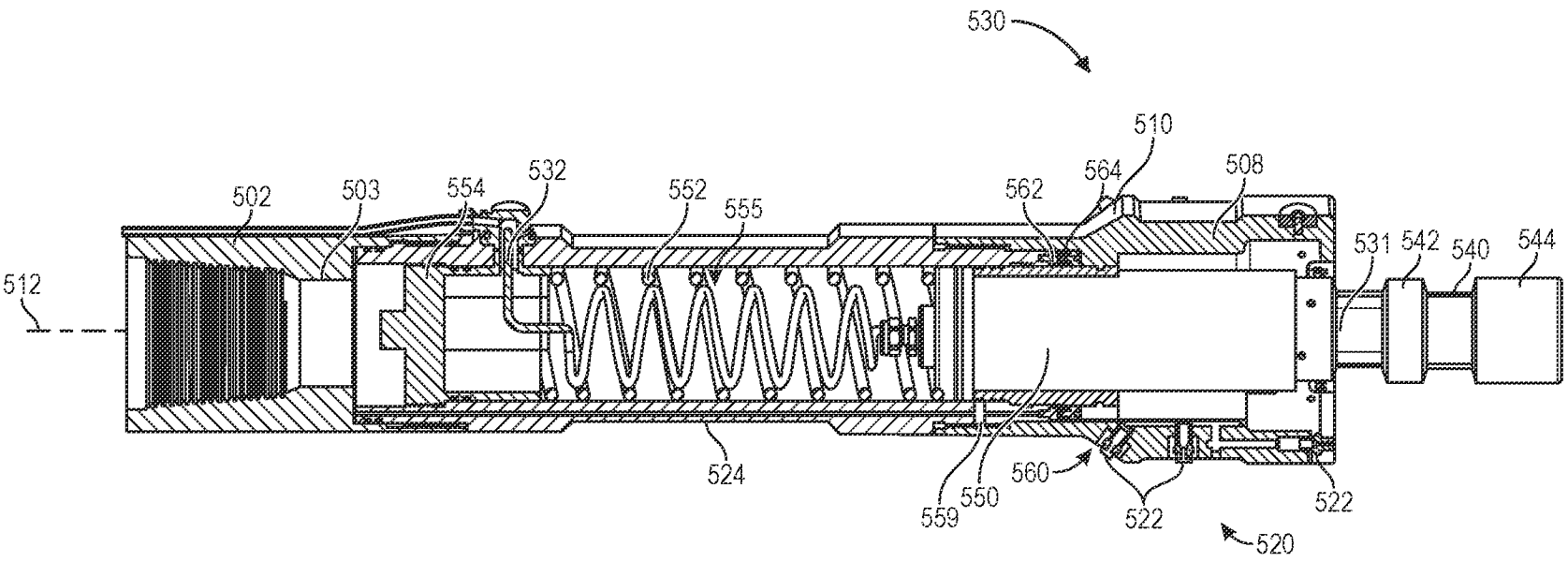
FIG. 5 illustrates a side, cross-sectional view of a second wellhead tool having an inspection system in an extended configuration, according to an embodiment.

FIG. 5 illustrates a side, cross-sectional view of another wellhead tool 500, according to an embodiment. The tool 500 includes a body 502, which may be a single (e.g., integral) component, or may include a plurality of components that are coupled (e.g., threaded) together. A bore 503 may be defined extending axially through the body 502. Further, the body 502 may include a radial protrusion 508 positioned therein. The radial protrusion 508 may be located proximal to a lower end of the body 502, e.g., extending from the lower end thereof, as shown.

The radial protrusion 508 may include a first (e.g., upper) surface portion 510. The upper surface portion 510 may be sloped at an angle with respect to a central longitudinal axis 512 through the body 502 such that a diameter of the body 502 increases proceeding in a downward direction (e.g., to the right in FIG. 5). The angle of the taper of the upper surface portion 510 may be from about 20° to about 90° (i.e., perpendicular to the axis) or about 30° to about 60°.

The wellhead tool 500 may also include a cleaning system 520. The cleaning system 520 may include one or more nozzles 522, which may be coupled to the body 502 and located in or on the radial protrusion 508. As described in greater detail below, a wash fluid may be pumped down through the body 502 and sprayed outward through the nozzles 522 at high pressure to clean an interior of a wellhead (e.g., to remove cement or debris from the interior of the wellhead). The nozzles 522 may be axially offset from one another with respect to the axis 512, circumferentially offset from one another with respect to the axis 512, or both. Further, the cleaning system 520 may include a wash line 524 which extends axially in the body 502, and is configured to deliver the wash fluid to at least the nozzles 522, as will be described in greater detail below.

The wellhead tool 500 may also include an inspection system 530. The inspection system 530 may be located at least partially within the bore 503 of the body 502, e.g., within the radial protrusion 508 and/or the cleaning system 520. A data line 532 may extend from the inspection system 530 and out of the body 502, so as to transmit data (images, video, etc.) to the surface from the camera. The data line 532 may not extend through a pressurized section of the body 502, and may thus not require specialized connectors or penetrators.

The inspection system 530 may include one or more cameras 531, e.g., a radial camera and an axial camera, as described above and shown in, e.g., FIGS. 1 and 2. The cameras 531 may be configured to view and/or record an interior of the wellhead to allow a user to determine whether the cleaning system 520 has cleaned the interior of the wellhead to a predetermined threshold. More particularly, the cameras 531 may capture images and/or video of the interior of the wellhead (e.g., a shoulder on the interior of the wellhead), and the images and/or video may be used to determine whether the cleaning system 520 has cleaned the shoulder of the wellhead such that a subsequent engagement between a tubing hanger and the shoulder is not compromised by cement or debris therebetween. The cameras 531 may be configured to capture the images and/or video before the cleaning system 520 cleans the interior of the wellhead, simultaneously with the cleaning system 520 cleaning the interior of the wellhead, after the cleaning system 520 cleans the interior of the wellhead, or a combination thereof.

A transparent portion 540 may be included, in which the cameras 531 are at least partially housed and through which the cameras are able to capture images. The transparent portion 540 may be or include a hollow tube made of glass, plastic, PLEXIGLAS®, or the like. For example, the transparent portion 540 may extend entirely around the radial camera. As will be appreciated, the transparent portion 540 is different/separate from a lens of the radial camera and/or the axial camera. For example, radial camera may include a radially oriented lens that is positioned within and spaced apart from the transparent portion 540.

The inspection system 530 may include one or more guards (two are shown: 542, 544). The guards 542, 544 may be positioned at least partially around the transparent portion 540 and configured to protect the transparent portion 540 and/or the cameras from contacting and/or being damaged by the wellhead. The guards 542, 544 may be axially offset from one another.

One or more markings may be visible to the camera 531, e.g., through the transparent portion 540. For example, the markings may be positioned on a structure, such as a shield, window, etc. The markings may be spaced apart by a known distance (e.g., axially spaced apart). The markings may thus be used to assist with depth perception (e.g., to gauge how far the interior of the wellhead is from the camera 531).

One or more lights may be configured to shine on the interior of the wellhead. The lights may shine upward, downward, radially outward, or a combination thereof. For example, the lights may shine radially outward, and the lights may be or include a ring or halo that shines downward. The lights may be or include light emitting diodes (LEDs). The lights may emit light in the visible or infrared spectrum.

The inspection system 530 may include a camera housing 550 that is movably positioned within the body 502 and which may contain, for example, electrical components of the cameras 531. The transparent portion 540 may be connected to the camera housing 550 and movable therewith.

The camera housing 550 includes a piston 551 and a biasing member 552 that bears against the piston 551. An interior collar 554 may be positioned within the body 502 and may engage the biasing member 552, opposite to the camera housing 550. The interior collar 554 may, for example, be held in position relative to the body 502, e.g., via a threaded connection with the bore 503, such that the interior collar 554 resists axial movement and permits the biasing member 552 to be compressed against the interior collar 554. An upper piston chamber 555 may be defined axially between the piston 551 and the interior collar 554, with the biasing member 552 being positioned therein. A lower piston chamber, which is not visible in this view, may be defined on an opposite axial side of the piston 551, as will be described below. A radial port 559 may connect the wash line 524 with the bore 503 below the piston 551.

A valve assembly 560 may be positioned in communication with the wash fluid line 556 and configured to control fluid flow therethrough to the nozzles 522. For example, the valve assembly 560 may include a poppet ring 562 and a wear housing 564. The poppet ring 562 may thus be configured to control (e.g., selectively block) fluid flow through the wash line 524 below a certain pressure. Upon reaching the pressure, the poppet ring 562 may be displaced from the wear housing 564, thereby actuating the valve assembly 560 to an open position and providing a flowpath therethrough to the nozzles 522. While the poppet ring 562 is blocking fluid flow therethrough, however, the valve assembly 560 is in a closed position and the poppet ring 562 directs fluid flow into the bore 503, below the piston 551, i.e., into the lower piston chamber 557.

In the illustrated configuration, the biasing member 552 is uncompressed, and the transparent portion 540 extends out of the bore 503, below the body 502. If wash fluid were to be sprayed in this configuration, the wash fluid, which may include abrasives (either in suspension or dislodged residual cement or other debris in the wellhead), may damage the relatively fragile transparent portion 540, such that it obstructs a clear view for the cameras 531 therein. Accordingly, the inspection system 530 is configured to retract the transparent portion 540 within the body 502.

Figure 6:
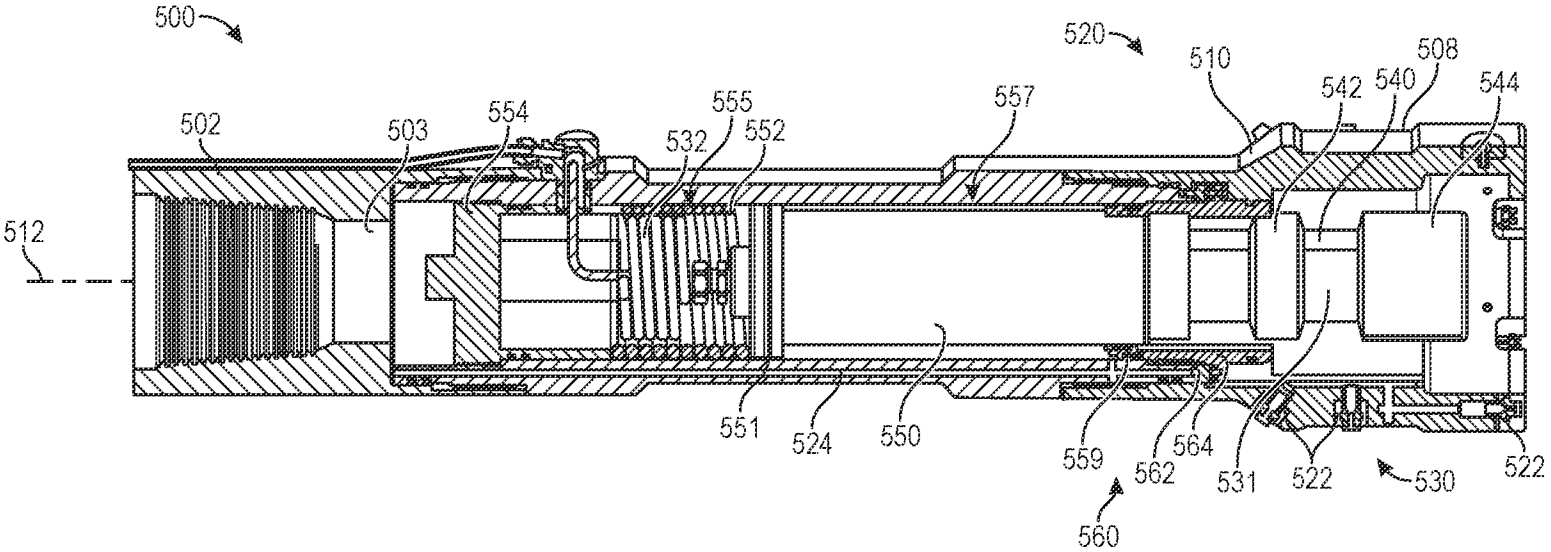
FIG. 6 illustrates a side, cross-sectional view of the second wellhead tool having the inspection system in a retracted configuration, according to an embodiment.

FIG. 6 illustrates a side, cross-sectional view of the tool 500 in such a retracted configuration, according to an embodiment. In this configuration, the wash fluid spraying through the nozzles 522 may not impinge upon the transparent portion 540, as the fluid may be sprayed at a position below and outside of the body 502, i.e., the body 502 protects the transparent portion 540.

As can be seen, in the retracted configuration, the upper piston chamber 555 has been reduced in volume by the piston 551 being advanced toward the interior collar 554, while compressing the biasing member 552. Accordingly, the aforementioned (but not previously visible) lower piston chamber 557 is visible as defined between the piston 551 and the seal between the wear housing 564 and the camera housing 550.

Actuation of the inspection system 530 from the default, extended configuration (FIG. 5) to the retracted configuration (FIG. 6) is now described. To clean the wellhead surfaces using the cleaning system 520, fluid is pumped into the bore 503 of the tool 501, e.g., from the upper end via connection with a running tool. This fluid is prevented from a direct path to the nozzles 522 by the interior collar 554. Thus, the fluid proceeds through the wash line 524 in the body 502, down to the valve assembly 560. The valve assembly 560, however, is biased closed, and the impingement of the fluid may be insufficient to open the valve assembly 560. Thus, the wash fluid is directed into the lower piston chamber 557 by the radially inward directed port 559. This raises the pressure in the lower piston chamber 557, driving the piston 551 upward and compressing the biasing member 552, thus actuating the inspection system 530 to its retracted configuration in which the transparent portion 540 is at least partially (e.g., entirely) within the bore 503 of the body 502.

Eventually, the piston 551 bottoms out or otherwise reaches an end range, such that volumetric expansion of the lower piston chamber 557 is no longer realized, and the pressure in the wash line 524 increases at the valve assembly 560. This increasing pressure eventually reaches the pressure at which the valve assembly 560 opens, thereby permitting the wash fluid to reach the nozzles 522, after the inspection system 530 has been retracted. When the washdown operation is complete and the fluid ceases pumping, the biasing member 552 may force the piston 551 back down within the body 502, again extending the transparent portion 540 to a position below the body 502 and permitting imaging of the surfaces that have been or are to be cleaned, i.e., the extended configuration. Thus, the pumping of the wash fluid is used to control the actuation of the tool 500. As such, the tool 500 automatically prevents the transparent portion 540 from being damaged by the wash fluid, as pumping the wash fluid causes the transparent portion 540 to retract.

Figure 7:
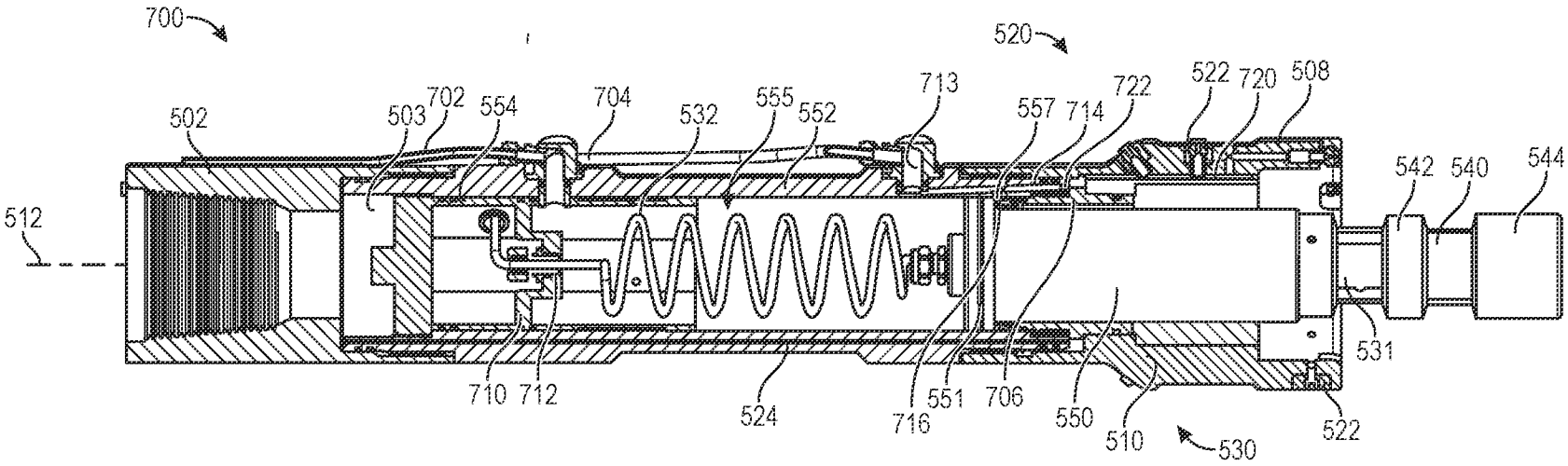
FIG. 7 illustrates a side, cross-sectional view of a third wellhead tool having an inspection system in an extended configuration, according to an embodiment.
Figure 8:
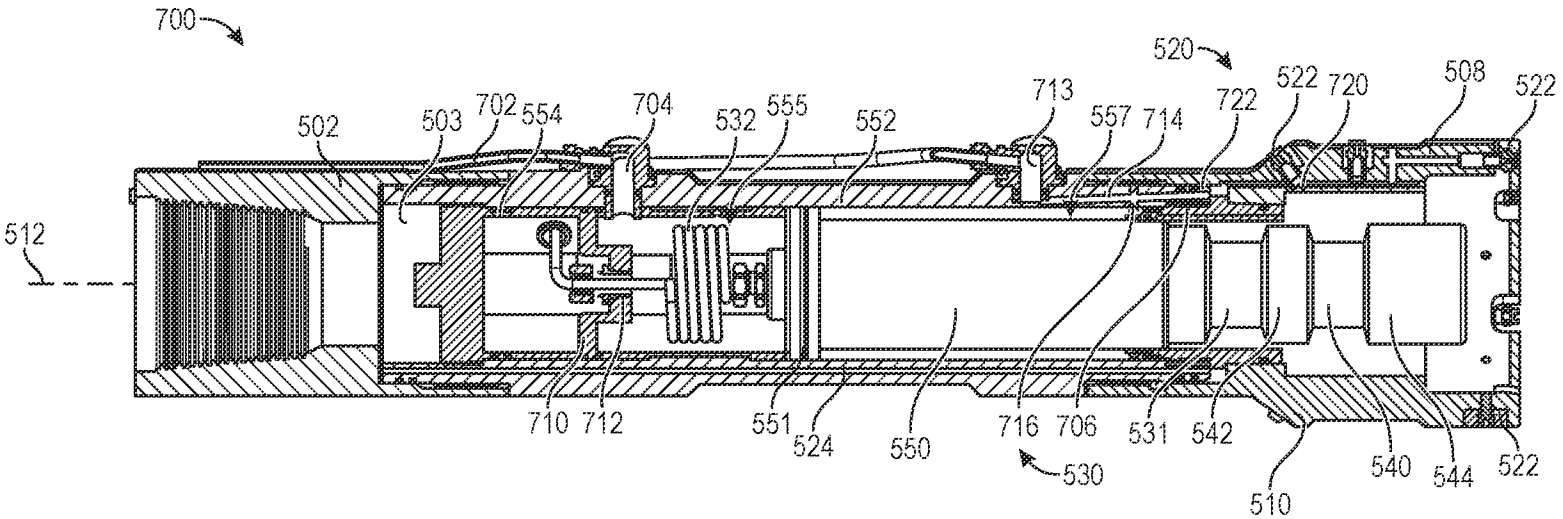
FIG. 8 illustrates a side, cross-sectional view of the third wellhead tool having the inspection system in a retracted configuration, according to an embodiment.

FIGS. 7 and 8 illustrate side, sectional views of another wellhead tool 700, according to an embodiment. In particular, FIG. 7 illustrates the wellhead tool 700 having the inspection system 530 thereof in an extended configuration, and FIG. 8 illustrates the wellhead tool 700 in a retracted configuration, according to an embodiment. The wellhead tool 700 may be generally similar to the wellhead tool 500 and similar components are given the same numbers where convenient, but not by way of limitation.

Accordingly, the wellhead tool 700 generally includes the inspection system 530 and the cleaning system 520, with the inspection system 530 including the one or more cameras 531 positioned at least partially within a transparent portion 540, and the cleaning system 520 including the nozzles 522. Moreover, the inspection system 530 may include one or more markings visible to the camera 531, e.g., through the transparent portion 540. For example, the markings may be positioned on a structure, such as a shield, window, etc. The markings may be spaced apart by a known distance (e.g., axially spaced apart). The markings may thus be used to assist with depth perception (e.g., to gauge how far the interior of the wellhead is from the camera 531).

One or more lights may be provided as part of the tool 700 and configured to shine on the interior of the wellhead. The lights may shine upward, downward, radially outward, or a combination thereof. For example, the lights may shine radially outward, and the lights may be or include a ring or halo that shines downward. The lights may be or include light emitting diodes (LEDs). The lights may emit light in the visible or infrared spectrum.

As with the wellhead tool 500, the camera body 550 is configured to move within the bore 503 between the extended and retracted configurations of the inspection system 530. In this embodiment, the actuation in either or both directions may be driven hydraulically. For example, the wellhead tool 700 includes a first hydraulic line 702 and a second hydraulic line 704. The first and second hydraulic lines 702, 704 may extend through the body 502 and may communicate with the bore 503 therein, e.g., on opposite axial sides of the piston 551. As best shown in FIG. 8, the piston 551 may separate the bore 503 into the upper piston chamber 555 and lower piston chamber 557. The wellhead tool 700 also include a packing sleeve 706, which forms a seal with the camera housing 550. The lower piston chamber 557 is defined axially between the piston 551 and the packing sleeve 706.

The wellhead tool 700 further includes a pressure barrier 710, e.g., formed as part of the interior collar 554. The upper piston chamber 555 is defined between the pressure barrier 710 and the piston 551. Further, pressure barrier 710 may include a port 712 through which the data line 532 may be received. The data line 532 may extend axially through the port 712 from the camera housing 550, and may, above the pressure barrier 710, then extend radially out of the body 502. The data line 532 may seal with the pressure barrier 710 in the port 712. Accordingly, the pressure barrier 710 may separate the penetration that permits the data line 532 to extend through the body 502 from the upper piston chamber 555.

The first hydraulic line 702 may communicate with the upper piston chamber 555 and the second hydraulic line 704 may communicate with the lower piston chamber 557. Accordingly, a pressure differential can be imposed across the piston 551, permitting control of the axial position of the camera housing 550 in the bore 703. In an embodiment, the second hydraulic line 704 may be coupled to a port 713, which may extend at least partially radially through the body 502. The port 712 may be coupled to an axial conduit 714 defined within the body 502. A radial conduit 716 intersects the axial conduit 714 and extends into the bore 703, e.g., axially between the piston 551 and the packing sleeve 706 (in the lower piston chamber 557).

As noted above with respect to the wellhead tool 500, the body 502 defines a wash line 524 therein. This wash line 524 terminates at the packing sleeve 706, and then continues via an extension 720 to the nozzles 522. The axial conduit 714 connected to the second hydraulic line 704 may be prevented from communication with the wash line 524 and the extension 720 by a plug 722.

Thus, when a higher pressure is generated in first hydraulic line 702 than in the second hydraulic line 704, the piston 551 and thus the camera housing 550 is driven toward the extended configuration (toward the right, as in FIG. 7). When a higher pressure is generated in the second hydraulic line 704 than in the first hydraulic line 702, the camera housing 550 is driven toward the retracted configuration (toward the left, as in FIG. 8). Wash fluid may be pumped through the wash line 524 and to the nozzles 522 via the extension 720 in either or both positions; however, in general, an operator may generally elect not to pump wash fluid through the tool 700 unless the tool 700 is in the retracted configuration, as the body 502 may protect the transparent portion 540 from abrasion/damage from the wash fluid impinging upon the transparent portion 540.

Figure 9:
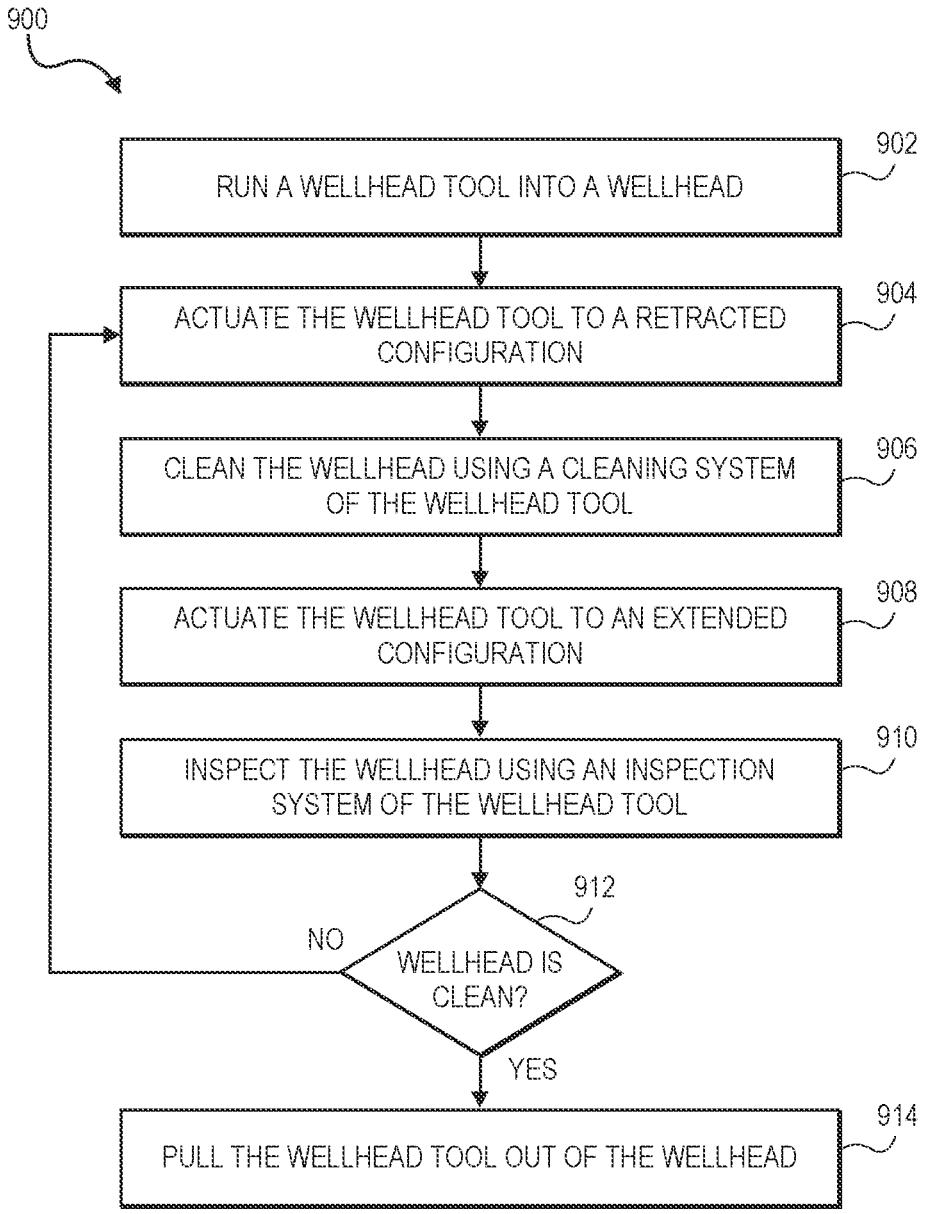
FIG. 9 illustrates a flowchart of a method for operating a wellhead tool, according to an embodiment.

FIG. 9 illustrates a flowchart of a method 900 for operating a wellhead tool that has a movable inspection assembly, e.g., the wellhead tool 500 and/or 700, according to an embodiment. The method 900 may include running the wellhead tool 500 or 700 into a wellhead, as at 902. The method 900 may include actuating the wellhead tool 500 or 700 (in particular, the inspection system 530 thereof) to a retracted configuration, as at 904. In the retracted configuration, the transparent portion 540 may be withdrawn into the bore 503, so as to prevent wash fluid from damaging the transparent portion 540.

The method 900 may also include cleaning the wellhead using a cleaning system 520 of the wellhead tool 500, 700, as at 906. For example, wash fluid may be pumped down into the tool 500, 700 and ejected through nozzles 522 onto the interior surfaces of the wellhead. In some embodiments, the inspection system 530 may be actuated into the retracted configuration by pressure supplied by the wash fluid. In other embodiments, a separate hydraulic system may be used to actuate the inspection system 530 to the retracted configuration, e.g., by increasing a pressure in the second hydraulic line 704 and/or decreasing a pressure in the first hydraulic line 702.

The method 900 may also include actuating the wellhead tool 500, 700 (e.g., the inspection system 530) to an extended configuration, as at 908. In some embodiments, the extended configuration may be the default position, and thus ceasing the cleaning operations may cause the actuation to the extended configuration. In other embodiments, the inspection system 530 may be selectively actuated to the extended configuration. For example, a pressure may be increased in the first hydraulic line 702 relative to the second hydraulic line 704, which generates a pressure differential across the piston 551, thereby moving the camera housing 550 relative to the body 502. This may result in the transparent portion 540 of the inspection system 530 extending out of the bore 503 so as to permit capture of images in the wellhead.

The method 900 may then include inspecting the wellhead using the inspection system 530, as at 910. For example, the camera 531 may capture images of the interior of the wellhead and send data representing the images from the camera 531 to a surface system. The method 900 may further include determining whether the wellhead is clean, as at 912. If so, the wellhead tool 500, 700 may be removed from the wellhead, as at 914. Otherwise, the method 900 may return to actuating the tool 500, 700 back to the retracted configuration and cleaning the wellhead. It will be noted that the tool 500, 700 may also be actuated to the retracted configuration after the wellhead is determined to be clean at 912, e.g., to protect the inspection system 530 during removal of the tool 500, 700 from the wellhead.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A tool, comprising:

a body defining a bore axially therein;

a cleaning system comprising nozzles coupled to the body and configured to spray a fluid onto an interior of a wellsite component; and an inspection system coupled to the body, wherein the inspection system is configured to capture images, video, or both of the wellsite component that are to be used to determine whether the wellsite component is clean after being sprayed with the fluid, wherein the inspection system comprises a piston that separates the bore into a lower piston chamber and an upper piston chamber, and wherein body is configured to deliver the fluid into the nozzles and into the lower piston chamber but not the upper piston chamber, so as to generate a pressure differential across the piston.

2. The tool of claim 1, wherein the wellsite component comprises a wellhead having one or more engagement surfaces, wherein the cleaning system is configured to clean the one or more engagement surfaces, and wherein the inspection system is configured to capture the images, video, or both of the one or more engagement surfaces without removing the cleaning system from the wellhead.

3. The tool of claim 1, wherein the inspection system comprises:

a first camera oriented in a radial direction relative to the body and configured to capture a first portion of the images, video, or both; and a second camera oriented in an axial direction relative to the body and configured to capture a second portion of the images, video, or both.

4. The tool of claim 3, wherein the inspection system further comprises one or more markings that are positioned radially outward from the first camera, and wherein the one or more markings are configured to be used to determine a distance between the first camera and the wellsite component.

5. The tool of claim 1, wherein the inspection system comprises a transparent tube and a camera positioned in the transparent tube, and wherein a line of sight of the camera extends through the transparent tube to the wellsite component.

6. The tool of claim 1, wherein the inspection system comprises:

a camera housing that is movably positioned at least partially in the bore; and a transparent portion coupled to the camera housing and movable therewith, wherein the inspection system has an extended configuration in which at least part of the transparent portion extends out of the bore and the camera is positioned to capture the images, video, or both through the transparent portion, and a retracted configuration in which the transparent portion is positioned at least partially within the bore.

7. The tool of claim 6, wherein, in the retracted configuration, the transparent portion is entirely within the bore.

8. The tool of claim 6, wherein the camera housing comprises the piston, and wherein piston is configured to move with respect to the body so as to actuate the inspection system from the extended configuration to the retracted configuration in response to the pressure differential between the upper and lower piston chambers.

9. The tool of claim 6, further comprising a biasing member positioned in the upper piston chamber and configured to actuate the inspection system to the extended configuration.

10. The tool of claim 1, further comprising a valve assembly coupled to the body, wherein the body comprises:

a wash line extending axially in the body, wherein the valve assembly controls a fluid flow through the wash line; and a radial port in communication with the lower piston chamber and the wash line, wherein the valve assembly in a closed position directs fluid flow from the wash line through the radial port and into the lower piston chamber, and wherein the valve assembly in an open position directs fluid flow to the nozzles.

11. The tool of claim 6, further comprising:

a first hydraulic line in communication with the upper piston chamber; and a second hydraulic line in communication with the lower piston chamber, wherein a difference in pressure between fluid in the first hydraulic line and fluid in the second hydraulic line generates the pressure differential across the piston.

12. The tool of claim 11, wherein a second pressure differential between the first hydraulic line and the second hydraulic line actuates the inspection system from the extended configuration to the retracted configuration.

13. The tool of claim 11, wherein the second hydraulic line penetrates the body and communicates with an axial conduit defined in the body, and wherein a radial conduit intersects the axial conduit and communicates with the lower piston chamber.

14. The tool of claim 11, further comprising:

an interior collar positioned in the bore and at least partially defining the upper piston chamber; and a data line in communication with the camera and extending axially through a port formed in the interior collar.

15. A method comprising:

positioning a wellhead tool in a wellhead, wherein the wellhead tool comprises:

a body defining a bore;

a cleaning system comprising nozzles coupled to the body and configured to spray a fluid onto an interior of a wellsite component; and an inspection system coupled to the body, wherein the inspection system is configured to capture images, video, or both of the wellsite component that are to be used to determine whether the wellsite component is clean after being sprayed with the fluid, wherein the inspection system comprises a piston that separates the bore into a lower piston chamber and an upper piston chamber, and wherein body is configured to deliver the fluid into the nozzles and into the lower piston chamber but not the upper piston chamber, so as to generate a pressure differential across the piston;

cleaning the wellhead using the cleaning system of the wellhead tool;

inspecting an interior of the wellhead using the inspection system without removing the wellhead tool from within the wellhead between cleaning and inspecting;

determining that the wellhead is clean based on the captured images, video, or both; and removing the wellhead tool from the wellhead in response to determining that the wellhead is clean.

16. The method of claim 15, further comprising actuating inspection system from a retracted configuration to an extended configuration after cleaning and before inspecting, wherein the inspection system comprises a camera and a transparent tube, the camera and the transparent tube being received within the body in the retracted configuration and the camera and the transparent tube extending out of the body in the extended configuration.

17. The method of claim 16, wherein cleaning comprising pumping the fluid through the body, and wherein pumping the fluid through the body causes the inspection system to actuate from the extended configuration to the retracted configuration.

18. The method of claim 16, wherein actuating the inspection system from the retracted configuration to the extended configuration comprises pumping a hydraulic fluid through a first hydraulic line into the body, on a first axial side of the piston, the method further comprising actuating the inspection system from the extended configuration to the retracted configuration by pumping a hydraulic fluid through a second line into the body.

19. A tool, comprising:

a body having a bore;

a cleaning system comprising nozzles coupled to the body and configured to spray a fluid onto an interior of a wellsite component; and an inspection system with a camera that is movable at least partially in the bore, wherein the inspection system includes a piston that separates the bore into an upper piston chamber and a lower piston chamber, wherein the piston is configured to move with respect to the body so as to actuate the camera from the extended configuration to the retracted configuration in response to a pressure differential between the upper and lower piston chambers, and wherein body is configured to deliver the fluid into the nozzles and into the lower piston chamber but not the upper piston chamber, so as to generate the pressure differential.

* * * * *